US009834295B2

(12) United States Patent
Cooper et al.

(10) Patent No.: US 9,834,295 B2
(45) **Date of Patent: *Dec. 5, 2017**

(54) SYSTEM AND METHOD FOR HEADING CONTROL OF A FLOATING LNG VESSEL USING A SET OF REAL-TIME MONITORED CARGO CONTAINMENT SYSTEM STRAIN DATA

(71) Applicant: Woodside Energy Technologies Pty Ltd., Perth (AU)

(72) Inventors: Steve John Cooper, Perth (AU); William David Hartell, Surbiton (GB)

(73) Assignee: WOODSIDE ENERGY TECHNOLOGIES PTY LTD., Perth (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/794,177

(22) Filed: Jul. 8, 2015

(65) Prior Publication Data

US 2016/0009353 A1 Jan. 14, 2016

(30) Foreign Application Priority Data

Jul. 9, 2014 (AU) ..... 2014902655
Sep. 15, 2014 (AU) ..... 2014224154

(51) Int. Cl.
*B63H 25/04* (2006.01)
*B63B 35/44* (2006.01)
(Continued)

(52) U.S. Cl.
CPC ..... *B63H 25/04* (2013.01); *B63B 21/507* (2013.01); *B63B 22/021* (2013.01); *B63B 27/34* (2013.01);
(Continued)

(58) Field of Classification Search
CPC ..... B63H 25/04; B63H 5/125; B63H 2005/1254; B63H 2025/045;
(Continued)

(56) References Cited

U.S. PATENT DOCUMENTS 4,315,408 A * 2/1982 Karl ..... F16L 11/22 138/107
4,501,525 A * 2/1985 Grundy ..... B63B 22/021 114/230.12
(Continued)

FOREIGN PATENT DOCUMENTS

WO 2014073973 A1 5/2014

OTHER PUBLICATIONS

Cadei. L., et al., FLNG—Floating Liquefied Natural Gas. An evolutionary way to unlock stranded and marginal gas fields, Norwegian University of Science and Technology, published Nov. 2013.
(Continued)

*Primary Examiner* — Yonel Beaulieu
*Assistant Examiner* — Angelina Shudy
(74) *Attorney, Agent, or Firm* — Edell, Shapiro & Finnan, LLC

(57) ABSTRACT

A system for offshore production of LNG from an FLNG vessel includes a floating LNG vessel including a hull and a deck, a topsides hydrocarbon processing facility installed at or above the deck of the hull of the FLNG vessel, a FLNG vessel cargo containment system comprising one or more insulated FLNG vessel cryogenic storage tanks installed within the hull of the FLNG vessel, a dynamic positioning control system operatively associated with a system of thrusters onboard the FLNG vessel where the dynamic positioning control system maintains the FLNG vessel at a desired heading around a station keeping point during LNG
(Continued)

cargo offloading operations, and a computer processor for receiving a set of real-time monitored environmental data.

22 Claims, 6 Drawing Sheets

(51) Int. Cl.
*B63H 5/125* (2006.01)
*B63B 21/50* (2006.01)
*B63B 22/02* (2006.01)
*B63B 27/34* (2006.01)

(52) U.S. Cl.
CPC ..... *B63B 35/44* (2013.01); *B63H 5/125* (2013.01); *B63B 2035/448* (2013.01); *B63B 2035/4486* (2013.01); *B63H 2005/1254* (2013.01); *B63H 2025/045* (2013.01)

(58) Field of Classification Search
CPC ..... B63B 21/507; B63B 22/021; B63B 27/34; B63B 35/44; B63B 2035/448; B63B 2035/4486
USPC ..... 701/21
See application file for complete search history.

(56) References Cited

U.S. PATENT DOCUMENTS 4,587,919 A * 5/1986 Loire ..... B63B 22/021 114/230.1
4,645,467 A * 2/1987 Pollack ..... B63B 21/508 114/230.15
5,803,779 A * 9/1998 Horton, III ..... B63B 22/021 114/230.23
7,438,617 B2 * 10/2008 Poldervaart ..... B63B 22/021 114/230.1
7,543,613 B2 * 6/2009 Adkins ..... B63B 27/24 141/1
8,104,416 B1 * 1/2012 Shivers, III ..... B63B 27/24 114/230.14
8,286,678 B2 * 10/2012 Adkins ..... B63B 22/026 114/230.15
8,398,445 B2 * 3/2013 Kokkinis ..... B63B 21/507 440/57
8,490,562 B1 * 7/2013 Shivers, III ..... B63B 27/24 114/230.14
8,490,564 B1 * 7/2013 Shivers, III ..... B63B 27/24 114/230.14
8,490,565 B1 * 7/2013 Shivers, III ..... B63B 27/24 114/230.14
8,490,566 B1 * 7/2013 Shivers, III ..... B63B 27/30 114/230.14
8,614,633 B1 * 12/2013 Lear ..... G08B 29/188 114/382
9,447,921 B2 * 9/2016 Liem ..... B63B 27/24
2006/0231155 A1 * 10/2006 Harland ..... B63B 22/026 141/11
2007/0095427 A1 * 5/2007 Ehrhardt ..... B63B 21/507 141/387
2007/0198175 A1 * 8/2007 Williams ..... G06Q 10/047 701/533
2009/0217861 A1 * 9/2009 Van Cann ..... E21B 7/124 114/77 A
2009/0272126 A1 * 11/2009 Mathews ..... F17C 9/02 62/50.2
2011/0232767 A1 * 9/2011 Liem ..... B63B 27/24 137/1
2014/0027008 A1 * 1/2014 Liem ..... B63B 27/24 141/1
2015/0007763 A1 * 1/2015 Morimoto ..... B63B 25/16 114/74 T
2015/0054460 A1 * 2/2015 Epstein ..... B60L 11/187 320/109
2015/0088346 A1 * 3/2015 Lee ..... B63B 9/001 701/21
2016/0009353 A1 * 1/2016 Cooper ..... B63B 21/507 701/21

OTHER PUBLICATIONS

FPSO-Presentation—Floating Production, Storage and Offloading (FPSO) Facilities, published Sep. 13, 2012 as per Wayback Machine. Retrieved from the Internet on Nov. 5, 2014 URL:http://www.energyclaims.net/assets/FPSO-Presentation.pdf.

* cited by examiner

SYSTEM AND METHOD FOR HEADING CONTROL OF A FLOATING LNG VESSEL USING A SET OF REAL-TIME MONITORED CARGO CONTAINMENT SYSTEM STRAIN DATA

CROSS REFERENCE TO RELATED APPLICATIONS

This application claims foreign priority under 35 U.S.C. §119(a)-(d) to Application Nos. AU 2014902655 filed on Jul. 9, 2014, and AU 2014224154 filed on Sep. 15, 2014, the entire contents of each of which are hereby incorporated by reference.

FIELD OF THE INVENTION

The present invention generally relates to a system for offshore production of LNG from an FLNG vessel, which system is connected to a natural gas receiving system with the FLNG vessel being located at a station keeping point. The present invention relates particularly to an FLNG vessel operated in dynamic positioning mode to provide heading control to the FLNG vessel using a set of real-time monitored cargo containment system strain data.

BACKGROUND

Liquefied natural gas is commonly referred to by the acronym 'LNG'. During recent years LNG has become an increasingly more sought-after energy resource. It is expected that natural gas will to an ever greater degree replace oil as an energy source.

It is known to cool natural gas down to about −163° C. to produce LNG at dedicated onshore export terminals. It is also known to load LNG into purpose built LNG tankers to transport the LNG at approximately atmospheric pressure to dedicated receiving terminals around the globe. It has been proposed for some time, that floating offshore structures, such as floating liquefaction vessels (referred to in the art as 'FLNG vessels'), could be used to liquefy natural gas although no such vessel has been put into production at this time.

It has been proposed that an FLNG vessel will be permanently moored to the seabed at a desired production location using a 'spread mooring system'. A spread mooring system relies on attaching heavy mooring lines or chains to the hull of the FLNG vessel and anchoring the chains to the seabed to ensure that weathervaning cannot occur. However, a spread mooring system is only an option in relatively benign locations where the prevailing weather is known to be highly directional. Such locations are not common.

Alternatively, it has been proposed that an FLNG vessel will be permanently moored to the seabed at a desired production location using a single point mooring system connecting it to the seafloor via a series of mooring lines (typically chains or wires). The mooring lines extend below sea level to the ocean floor and can cost in the order of one hundred million US dollars. A single point mooring system is placed within or adjacent to the FLNG vessel. The single point mooring system is designed to receive a stream of hydrocarbons delivered to the single point mooring through one or more production risers connected to wells on the sea floor. In addition to this, well risers, umbilicals and other subsea services necessary to the operation of the FLNG vessel and its associated feed gas architecture pass through the single point mooring system. In addition to performing this function, prior art single point mooring systems are designed and sized to moor the FLNG vessel at or near a preset longitude and latitude whilst allowing the FLNG vessel to freely weathervane around the single point mooring. Such single point mooring turrets are designed and sized such that the FLNG vessel can remain moored and weathervane around the single point mooring system whilst withstanding the forces of up to a 10000 year storm so that FLNG vessel remains fixed to the single point mooring at all times during the producing life of the FLNG vessel. Consequently, the proposed FLNG vessel are designed to have no means for self-propulsion with the result that it operates more like a barge than a ship.

Using the single mooring systems currently proposed for use for FLNG vessels, the proposed FLNG vessel is held on a station keeping point by the suitably sized single point mooring system and the orientation or 'heading' of the FLNG vessel is primarily dependent on the weather conditions, current direction, wind direction, and wave direction. Such single point mooring systems are extremely large, extremely complex and extremely expensive, costing in the order of 500 to 900 million US dollars. If there is a desire to hold the FLNG vessel at a heading that differs from the weathervaning heading, the FLNG vessel must be fitted with thrusters that are located aft of the single point mooring system so as to cause the FLNG vessel to be rotated around the single point mooring system, either alone or in combination with a separate self-propelled vessel such as a tug boat that is used to apply a local pushing or pulling force to the hull of the FLNG vessel to provide heading control.

There remains a need for an alternative system for heading control of an FLNG vessel during offloading of LNG.

SUMMARY

According to a first aspect of the present invention there is provided a system for offshore production of LNG from an FLNG vessel, which system is connected to a natural gas receiving system, wherein the system comprises:

a floating LNG vessel having a hull and a deck;

a topsides hydrocarbon processing facility installed at or above the deck of the hull of the FLNG vessel;

a FLNG vessel cargo containment system comprising one or more insulated FLNG vessel cryogenic storage tanks installed within the hull of the FLNG vessel;

a dynamic positioning control system operatively associated with a system of thrusters onboard the FLNG vessel wherein the dynamic positioning control system maintains the FLNG vessel at a desired heading around a station keeping point during LNG cargo offloading operations; and, a computer processor for receiving a set of real-time monitored environmental data, wherein the computer processer is programmed with a mathematical algorithm to:

(i) compare the set of real-time monitored environmental data to a set of stored set points held in a data storage means;

(ii) generate a heading control correction signal when the set of real-time monitored environmental data exceeds or falls below one or more of the set of stored set points for the FLNG vessel; and, (iii) transmit the heading control correction signal to the dynamic positioning control system during offloading operations;

wherein the set of real-time monitored environmental data includes a set of real-time monitored cargo containment system strain data associated with a level of strain experienced by the FLNG vessel cargo containment, and, the set of stored set points is a set of real-time monitored cargo containment system integrity set points.

In one form, the set of real-time monitored cargo containment system strain data is generated in part or in full by one or more of the following hull integrity sensors: a storage tank strain gauge, a storage tank pressure sensor, a storage tank level indicator, a storage tank temperature sensor; a storage tank loading rate sensor; a storage tank offloading rate sensor; a storage tank sloshing sensor; a storage tank cargo load sensor, and, a storage tank accelerometer.

In one form, the set of stored set points held in the data storage means is a set of stored cargo containment system sloshing set points.

In one form, the computer processor has source or executable instructions to communicate with a network to form an executive dashboard enabling a remote user to view the set of real-time monitored environmental data 24 hours a day, 7 days as week.

In one form, the set of real-time monitored environmental data includes a set of metocean data sourced from an external data supplier.

In one form, the set of metocean data is sourced from a sensing location that is remote from the station keeping point for providing forward warning of a predicted change in environmental conditions during offloading operations.

In one form, the system includes a set of environmental sensors for generating part or all of the set of real-time monitored environmental data.

In one form, the set of environmental sensors includes one or more of the following environmental condition data sensors: a wind sensor, a wave sensor, a current sensor, a swell sensor, a temperature sensor, a remote wave buoy, or combinations thereof.

In one form, the set of real-time monitored environmental data includes a set of LNG production data associated the production of LNG by the topside hydrocarbon production facility.

In one form, the set of LNG production data comprises data generated by one or more of the following: a flow rate sensor for the outlet stream of the liquefaction facility; a LNG temperature sensor; a loading rate sensor for each of the plurality of FLNG vessel cryogenic storage tanks; a pressure sensor for each of the plurality of FLNG vessel cryogenic storage tanks; an offloading rate sensor for each of the plurality of FLNG vessel cryogenic storage tanks.

In one form, the set of stored set points held in the data storage means is a set of stored topsides hydrocarbon processing facility integrity set points. In one form, the set of stored set points held in the data storage means is a set of stored topsides hydrocarbon processing facility liquid level or flow control set points.

In one form, the system of thrusters includes one or more tunnel or pod thrusters, each tunnel or pod thruster having an adjustable thruster output, and, the dynamic positioning control system maintains the FLNG vessel at a desired heading around a station keeping point during LNG production operations by adjusting the output of one or both of the bow thruster and the stern thruster.

In one form, the system of thrusters includes one or more azimuthal thrusters, each azimuthal thruster having an adjustable thruster output and an adjustable thruster angle and, the dynamic positioning control system maintains the FLNG vessel at a desired heading around a station keeping point during LNG production operations by adjusting one or both of the output and the angle of at least one of the plurality of azimuthal thrusters.

In one form, the system of thrusters comprises one or more tunnel or pod thrusters, each tunnel or pod thruster having an adjustable thruster output, and, one or more azimuthal thrusters, each azimuthal thruster having an adjustable thruster output and an adjustable thruster angle, and, the DP control system of the present invention achieves heading control of the FLNG vessel by adjusting one or both of (i) the output and the angle of at least one of the plurality of azimuthal thrusters; and (ii) the output of the tunnel or pod thruster.

In one form, the system includes a power generation and distribution system for sharing power between the dynamic positioning control system and the topsides hydrocarbon processing facility.

In one form, the power generation and distribution system is configured to charge a battery bank for the dynamic positioning control system when the topsides hydrocarbon processing facility is experiencing an off-peak load condition.

In one form, the FLNG vessel is operated in dynamic positioning mode for station keeping in addition to heading control. In one form, the dynamic positioning control system is located on the FLNG vessel.

In one form, the real-time monitored environmental data is stored to provide a measure of the cumulative load hours experienced by the FLNG vessel over the operating life of the FLNG vessel for providing a guideline to inform a maintenance schedule for the FLNG vessel. In one form, the real-time monitored environmental data is analyzed to update the mathematical algorithm or to reset the value of the set of stored set points.

According to a second aspect of the present invention there is provided a method for offshore production of LNG from an FLNG vessel using the system of any one form of the first aspect of the present invention.

BRIEF DESCRIPTION OF THE DRAWINGS

In order to facilitate a more detailed understanding of the nature of the invention several embodiments of the present invention will now be described in detail, by way of example only, with reference to the accompanying drawings, in which.

Figure 1:
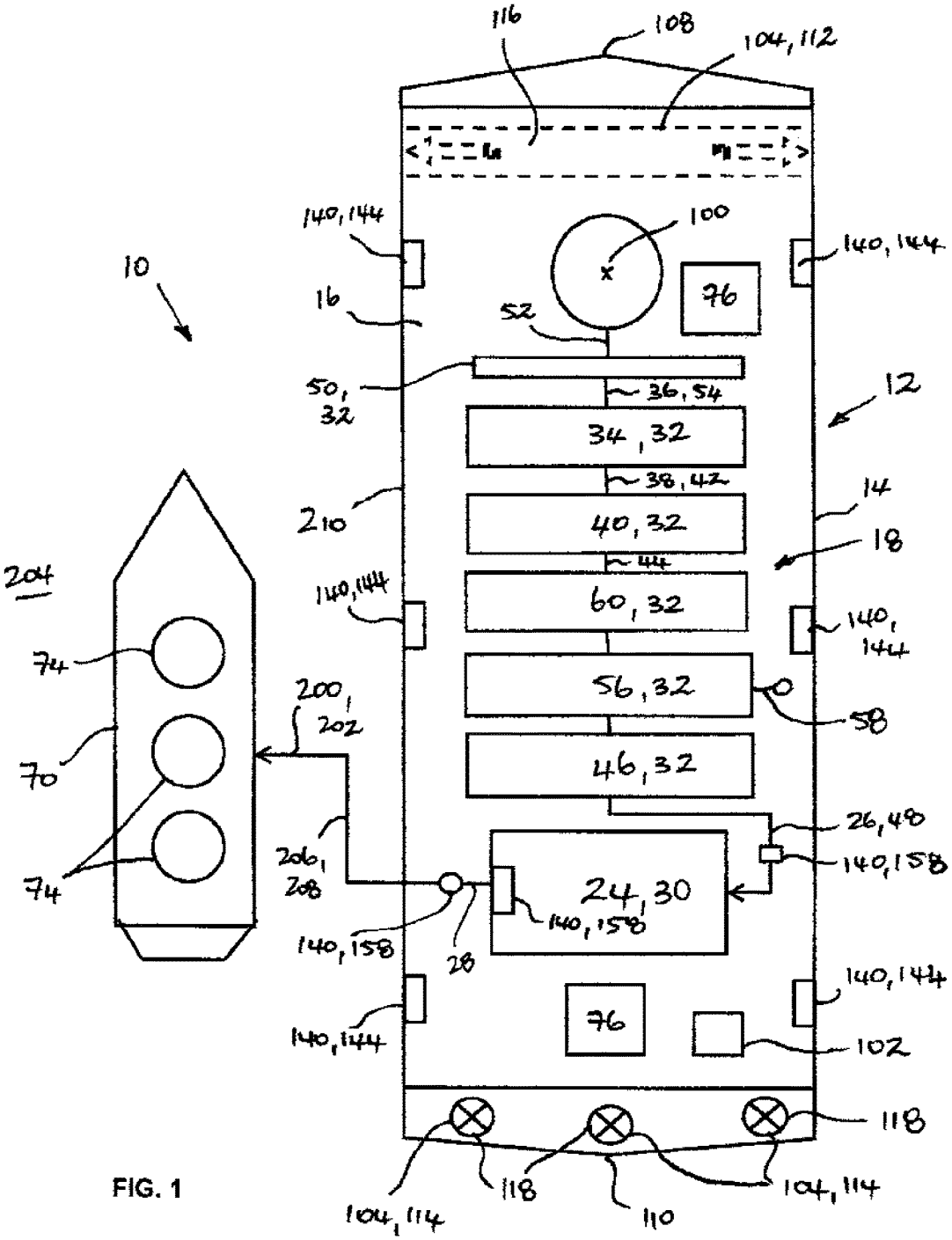
FIG. 1 is a schematic top view of one embodiment of the present invention showing an FLNG vessel with a turret within the hull and a topsides hydrocarbon processing facility including a liquefaction facility and a gas pre-treatment facility on or above the deck, showing an LNG tanker arranged side by side with the FLNG vessel for offloading a cargo of LNG.

It is to be noted that the drawings illustrate only preferred embodiments of the invention and are therefore not to be considered limiting of the invention's scope as it may admit to other equally effective embodiments. Like reference numerals refer to like parts. The components in the figures are not necessarily to scale, emphasis instead being placed upon illustrating the principles of the invention. Moreover, all drawings are intended to convey concepts, where relative sizes, shapes and other detailed attributes may be illustrated schematically rather than literally or precisely.

DETAILED DESCRIPTION

Particular embodiments of the present invention are now described. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs.

The term 'natural gas' refers to a gas that is primarily methane gas with small amounts of ethane, propane, butane, and a percentage of heavier components. The acronym 'LNG' is used throughout this specification and the claims to refer to liquefied natural gas.

The acronym 'LPG' is used throughout this specification and the claims to refer to liquefied petroleum gas. The acronym TLNG' is used throughout this specification and the claims to refer to 'floating liquefied natural gas'. Thus the term TLNG vessel' means a floating liquefied natural gas vessel which receives a source of natural gas and produces LNG onboard the vessel. The term 'LNG tanker' is used to refer to a vessel that receives a cargo of LNG and transports that cargo of LNG to a location that is remote from the location where the cargo was received. The acronym 'DP" is used throughout this specification and the claims to refer to 'dynamic positioning'.

The term 'environmental conditions' is used to refer to the combined effect of the magnitude of weather conditions including wind direction, wind velocity, wave direction, and, wave height, and also includes other metocean conditions such as current direction and current velocity, air temperature, air pressure and the like.

The term 'single point mooring system' is used to refer to a system that serves two primary functions. The first primary function of the single point mooring system is that of mooring a vessel at or near a desired station keeping point whilst allowing the vessel to weathervane around it. The second primary function is that of receiving a stream of hydrocarbons delivered to the single point mooring system through one or more production risers connected to wells on the sea floor. In addition to this, well risers, umbilicals and other subsea services necessary to the operation of the FLNG vessel and its associated feed gas architecture pass through the single point mooring system.

The term 'hydrocarbon production turret' is used throughout this specification and the claims to refer to a device that serves the single primary function of receiving a stream of hydrocarbons delivered to the turret through one or more production risers connected to wells on the sea floor. In addition to this, well risers, umbilicals and other subsea services necessary to the operation of the FLNG vessel and its associated feed gas architecture pass through the turret. The turret includes a swivel to accommodate changes in the heading of the FLNG vessel. In contrast to a single point mooring system, a hydrocarbon production turret (as defined in this specification and the claims) is not designed and sized to serve the primary function of mooring a vessel at or near a desired station keeping point. As such, a hydrocarbon production turret may assist in positioning the vessel at or near a desired station keeping point but this is not one of its primary functions.

Before describing the system of the present invention in detail, embodiments of an FLNG vessel suitable to be included in the system (10) and method of the present invention are first described with reference to FIGS. 1 to 4. The FLNG vessel (12) has a hull (14) and a deck (16). In order to facilitate offshore production of LNG by the FLNG vessel, the FLNG vessel has a topsides hydrocarbon processing facility (18) installed on or above the deck of the hull of the FLNG vessel and an FLNG vessel cargo containment system (20) comprising a plurality of insulated FLNG vessel cryogenic storage tanks (22) installed within the hull. The topsides hydrocarbon processing facility consists of a plurality of interconnected systems which allow the FLNG vessel to produce sales-quality LNG (optionally LPG and condensate) in a standalone fashion in relative close proximity to a hydrocarbon reservoir. The topsides hydrocarbon processing facility is designed and sized so that the FLNG vessel has an anticipated production capacity in the range of 0.5 and 7 million tonnes of LNG per annum, preferably in the range of 1 to 4 million tonnes of LNG per annum. The topsides hydrocarbon processing facility includes at least a liquefaction facility (24) arranged to receive an inlet stream (26) of dry sweet natural gas and generate an outlet stream of LNG (28). The liquefaction facility includes one or more cryogenic heat exchangers (30) arranged in series or parallel. Each cryogenic heat exchanger is a spiral wound heat exchanger or a braised aluminium heat exchanger. The liquefaction facility may include a spiral wound heat exchanger being used in parallel or in series with a braised aluminium heat exchanger. The liquefaction facilities operate using a cycle selected from the list comprising: a nitrogen cycle; a single mixed refrigerant cycle; a dual mixed refrigerant cycle; a cascade refrigerant cycle; a hybrid liquefaction cycle, a carbon dioxide and nitrogen liquefaction cycle, or another natural gas liquefaction cycle. Such liquefaction cycles are well known in the LNG production arts and need not be described here as the selection of liquefaction cycle does not form part of the present invention.

Figure 2:
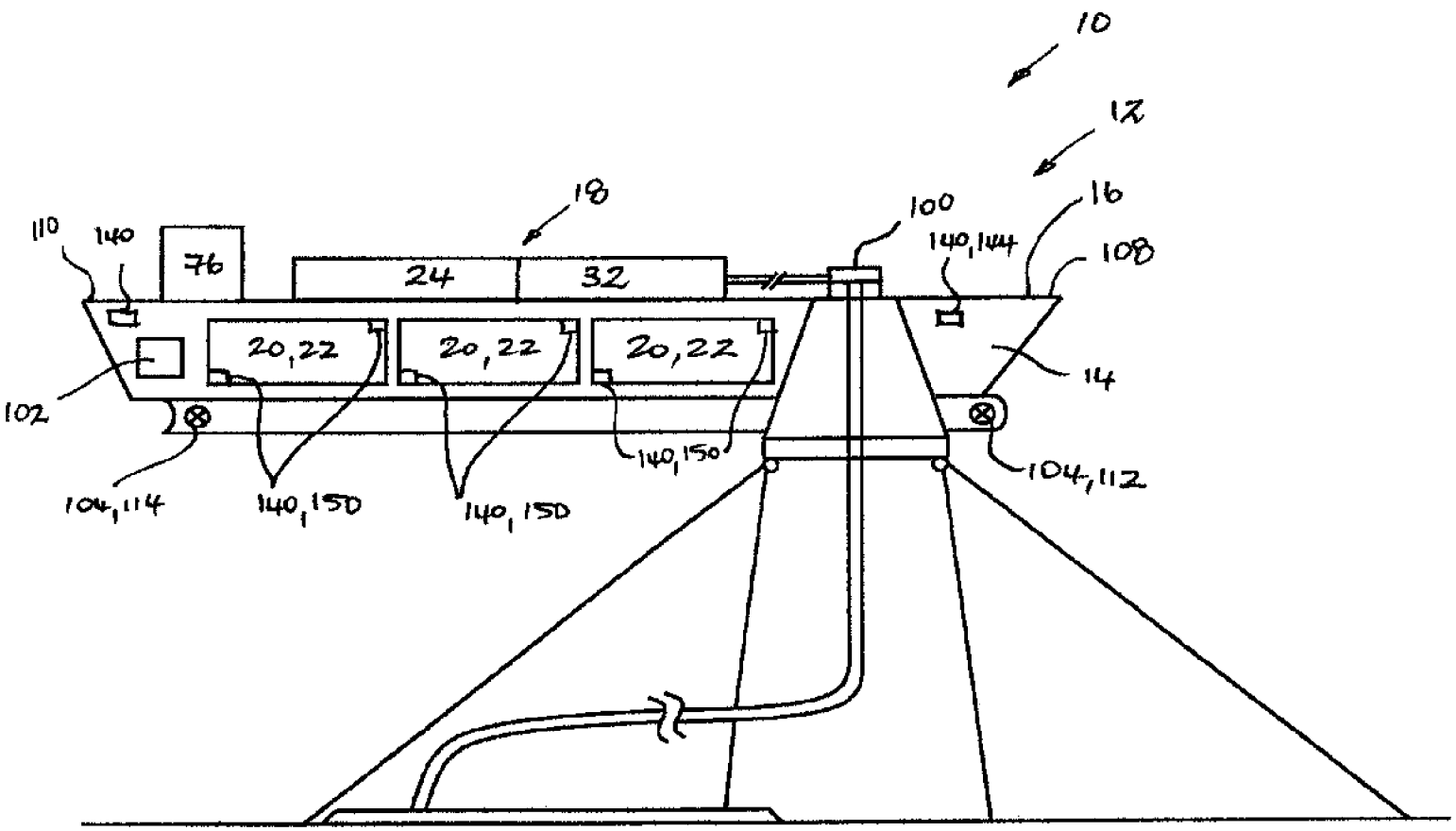
FIG. 2 is a schematic side view of the embodiment of FIG. 1 with the LNG tanker omitted for clarity.
Figure 3:
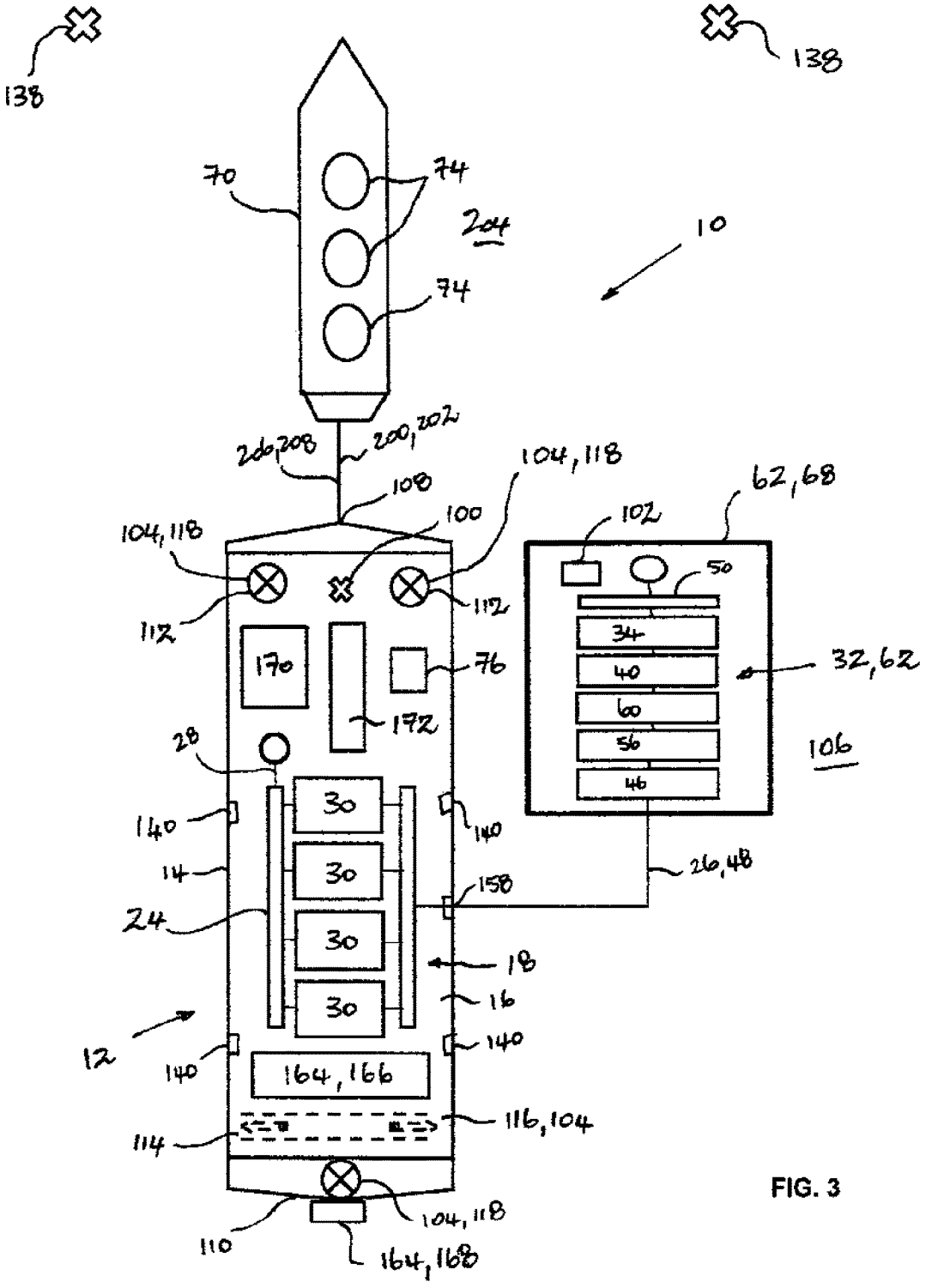
FIG. 3 is a schematic top view of one embodiment of the present invention showing an FLNG vessel with a turret outside of the hull and a topsides hydrocarbon processing facility including a liquefaction facility with an off-board gas pre-treatment facility, the FLNG vessel including a dedicated propulsion system, showing an LNG tanker arranged bow to stern with the FLNG vessel for tandem offloading a cargo of LNG; and, FIG. 4 is a schematic side view of the embodiment of FIG. 3 with the LNG tanker omitted for clarity.
Figure 4:
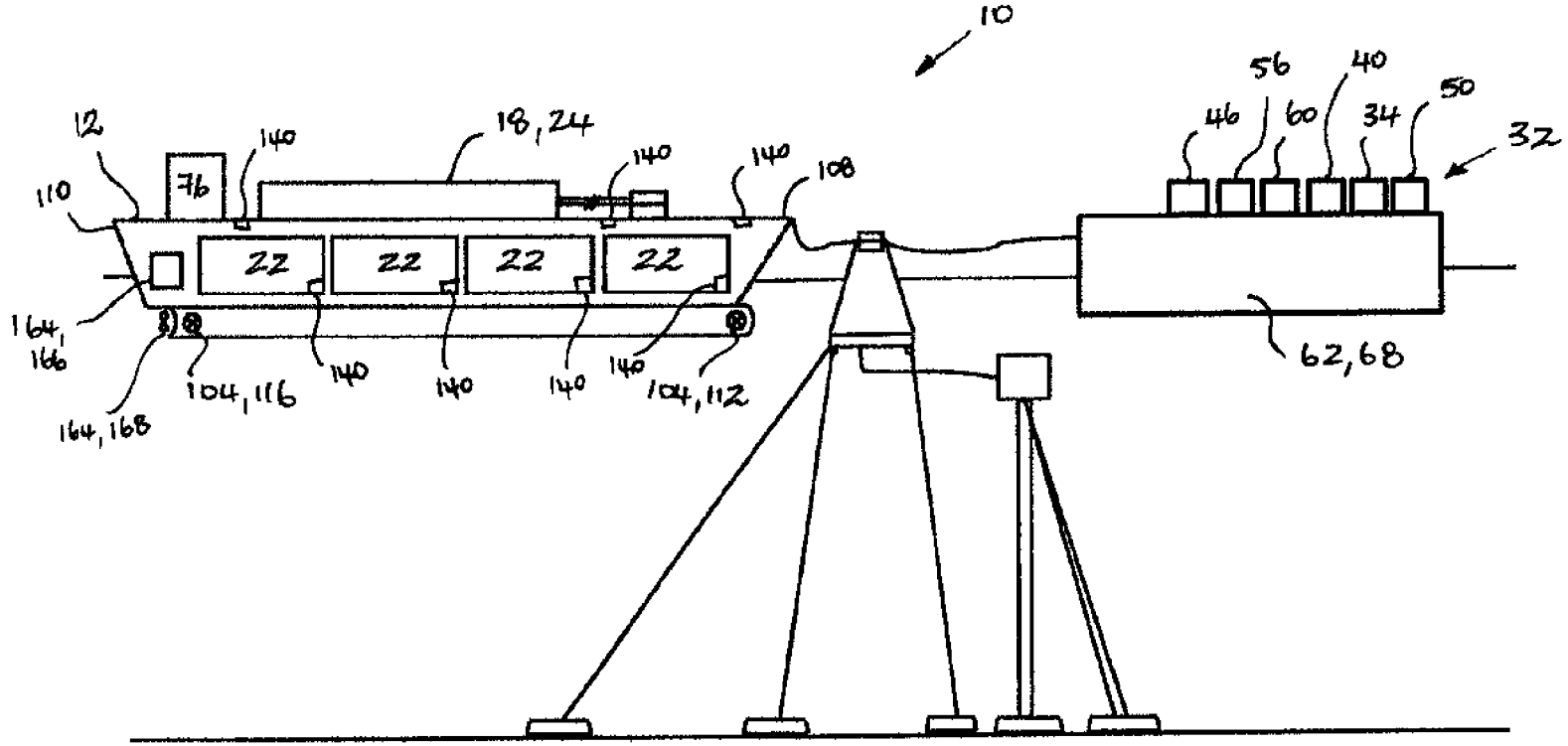

Referring to FIGS. 1 and 2, the topsides hydrocarbon processing facility (18) includes a gas pre-treatment facility (32). The gas pre-treatment facility includes an acid gas removal facility (34) for receiving a stream of sour natural gas (36) and producing a stream of sweet natural gas (38) and a dehydration facility (40) for receiving a stream of wet natural gas (42) and producing a stream of dry natural gas (44). The topsides hydrocarbon processing facility may further include a pre-cooling facility (46) wherein the inlet stream of dry sweet natural gas (26) fed to the liquefaction facility (24) is a stream of pre-cooled dry sweet gas (48) produced by the pre-cooling facility. Additionally, the gas pre-treatment facility may include a wellhead gas separator (50) for removing liquids and solids from an inlet stream of hydrocarbon reservoir fluids (52) to produce a stream of wet sour natural gas (54). The gas pre-treatment facility may further include a condensate removal facility (56) for removing a stream of condensate (58) comprising pentane, propane, and butane which can be further processed to produce LPG or stored for sale as condensate. The gas pre-treatment facility includes a mercury removal facility (60) for removal of mercury upstream of the liquefaction facility. Various kinds of suitable gas pre-treatment facilities are well known in the art and are not described in detail here as the type and kind of gas pre-treatment facilities do not form part of the present invention.

In the embodiment illustrated in FIGS. 1 and 2, the topsides hydrocarbon processing facility (18) includes the gas pre-treatment facility (32) and the liquefaction facility (24) onboard the FLNG vessel. In alternative embodiments illustrated in FIGS. 3, 4 and 5, the liquefaction facility is located onboard the FLNG vessel as part of the topsides hydrocarbon processing facility, while the gas pre-treatment facility is an off-board gas pre-treatment facility (62). In the embodiment illustrated in FIG. 3, the off-board gas pre-treatment facility is arranged on a floating structure (68). The floating structure can be a floating gas pre-treatment vessel, a semi-submersible platform, a tender-assisted self-erecting structure, a tension-leg platform, a normally unmanned platform, a satellite platform, or a spar. If desired, the floating structure (68) can be provided with a second dynamic positioning control system that communicates with the dynamic positioning control system of the FLNG vessel (described in detail below) to assist in maintaining safe separation distance at all times during operations. In the embodiment illustrated in FIG. 5, the off-board gas pre-treatment facility is arranged on a fixed structure (64) at a gas production location (66) outside of the station keeping envelope of the FLNG vessel. The fixed structure can be a fixed platform, a tension-leg platform, a fixed jacket structure or a gravity based structure, depending on such relevant factors as the contours and depth of the sea bed at the gas production location.

The outlet stream of LNG (28) of the liquefaction facility (24) of the FLNG vessel (12) may be directed to flow into the FLNG vessel cargo containment system (20). Alternatively, if an LNG tanker (70) having an LNG tanker cargo containment system (74) comprising a plurality of LNG tanker cryogenic storage tanks (74) is available to receive a cargo of LNG, the outlet stream of LNG of the liquefaction facility of the FLNG vessel may be directed to flow into the LNG tanker cargo containment system. Each of the FLNG vessel insulated cryogenic storage tanks (22) can be a membrane storage tank maintained at ambient pressure or a prismatic type containment system or a Moss-style tank, or combination thereof. The insulation on the LNG storage tanks allows some of the LNG to warm over time and return to its gaseous form (a process referred to in the art as "boil off"). The storage tanks are operated in such a manner that removal of the boil off gas allows the remaining LNG to be maintained at a constant cold temperature, typically −163° C. in its liquid form. The plurality of FLNG vessel cryogenic storage tanks can each be interconnected, but are preferably independent of each other. The FLNG vessel cargo containment system has a storage capacity in the range of 90,000 $m^3$-300,000 $m^3$, depending on a number of relevant factors including the production capacity of the topsides LNG production facilities.

A plurality of additional systems (generally designated by reference numeral 76) may also be built into and/or onto the FLNG vessel hull. The plurality of additional systems may include: the electrical utility systems, the cargo containment systems and associated pumps; fans or other equipment associated with the topsides hydrocarbon processing facility; the lighting systems; the accommodation unit; the communications systems; the air supply systems; the water systems; and, the waste treatment systems, and cranes or lifting systems. In order to accommodate the topsides hydrocarbon processing facility and the plurality of additional systems, the FLNG vessel may be a steel single-hulled or double-hulled vessel having a length in the range of 200 to 600 meters and a width (or "beam") in the range of 40 to 90 meters. By comparison, a prior art LNG tanker in operation at this time has a maximum hull length or around 350 meters and a maximum width of 55 meters. Depending on the level of complexity of the topsides hydrocarbon processing facility and the anticipated production capacity of the FLNG vessel, it is likely that the FLNG vessel will be larger or much larger in size than a prior art LNG tanker that is used to receive and transport LNG cargoes.

Various embodiments of a system (10) for offshore production of LNG from an FLNG vessel, which system is connected to a source of natural gas, are now described in detail. The system is characterised in that the FLNG vessel (12) is located at a station keeping point (100) and the FLNG vessel is operated in dynamic positioning mode to provide heading control to the FLNG vessel during LNG offloading operations. The term 'offloading operations' includes a set of operations associated with the transfer of a cargo of LNG from the FLNG vessel to an LNG tanker. The system of the present invention can be used whereby the FLNG vessel is operated in dynamic positioning mode to provide heading control to the FLNG vessel during LNG cargo offloading operations so that the FLNG vessel provides a breakwater for an LNG tanker during LNG offloading operations. Alternatively or additionally, the FLNG vessel can be operated in dynamic positioning mode to provide heading control to the FLNG vessel during LNG cargo offloading operations so that the FLNG vessel maintains a safe separation distance between the FLNG vessel and LNG tanker during LNG offloading operations.

The term 'offloading operations' also covers a set of operations associated with side-by-side or tandem mooring of the LNG tanker with the FLNG vessel. The 'offloading operations' can also include operations undertaken in anticipation of offloading, for example during a period of time when the LNG tanker is making its approach to the FLNG vessel. The system of the present invention can be used so that the FLNG vessel is operated in dynamic positioning mode to provide heading control to the FLNG vessel so that the FLNG vessel provides a breakwater for an LNG tanker while the LNG tanker approaches the FLNG vessel during LNG offloading operations.

The system includes a dynamic positioning control system (102) operatively associated with a system of thrusters (104 onboard the FLNG vessel wherein the dynamic positioning control system maintains the FLNG vessel at a desired heading around a station keeping point during LNG offloading operations. The DP control system may be located on the FLNG vessel itself or operated from a remote DP operation location (106).

When the hull of the FLNG vessel has a rectangular or 'ship-shaped' footprint (as illustrated in the embodiments shown in FIGS. 1 to 4), the FLNG vessel has a bow (108) and stern (110), and, the system of thrusters (104) can include one or more bow thrusters (112) and one or more stern thrusters (114). The system of thrusters can include one or more tunnel or pod thrusters (116), each tunnel or pod thruster having an adjustable thruster output. Alternatively or additionally, the system of thrusters can include one or more azimuthal thrusters (118), each azimuthal thruster having an adjustable azimuthal thruster output and an adjustable thruster angle. The system of thrusters can comprise one or more tunnel or pod thrusters and one or more azimuthal thrusters.

In the embodiment illustrated in FIG. 1, the hull (14) of the FLNG vessel (12) has a rectangular footprint and is provided with a tunnel thruster (116) at the bow (108) and three azimuthal thrusters (118) at the stern (110). In the embodiment illustrated in FIG. 3, the hull of the FLNG vessel has a rectangular footprint and the system of thrusters includes a tunnel thruster (116) and an azimuthal thruster (118) at the stern (110) and two azimuthal thrusters (118) at the bow (108). Using these embodiments, the DP control system of the present invention achieves heading control of the FLNG vessel by adjusting one or both of (i) the output and the angle of at least one of the plurality of azimuthal thrusters; and (ii) the output of the tunnel thruster. Pod thrusters could equally be used in the place of the tunnel thrusters in this embodiment.

Figure 5:
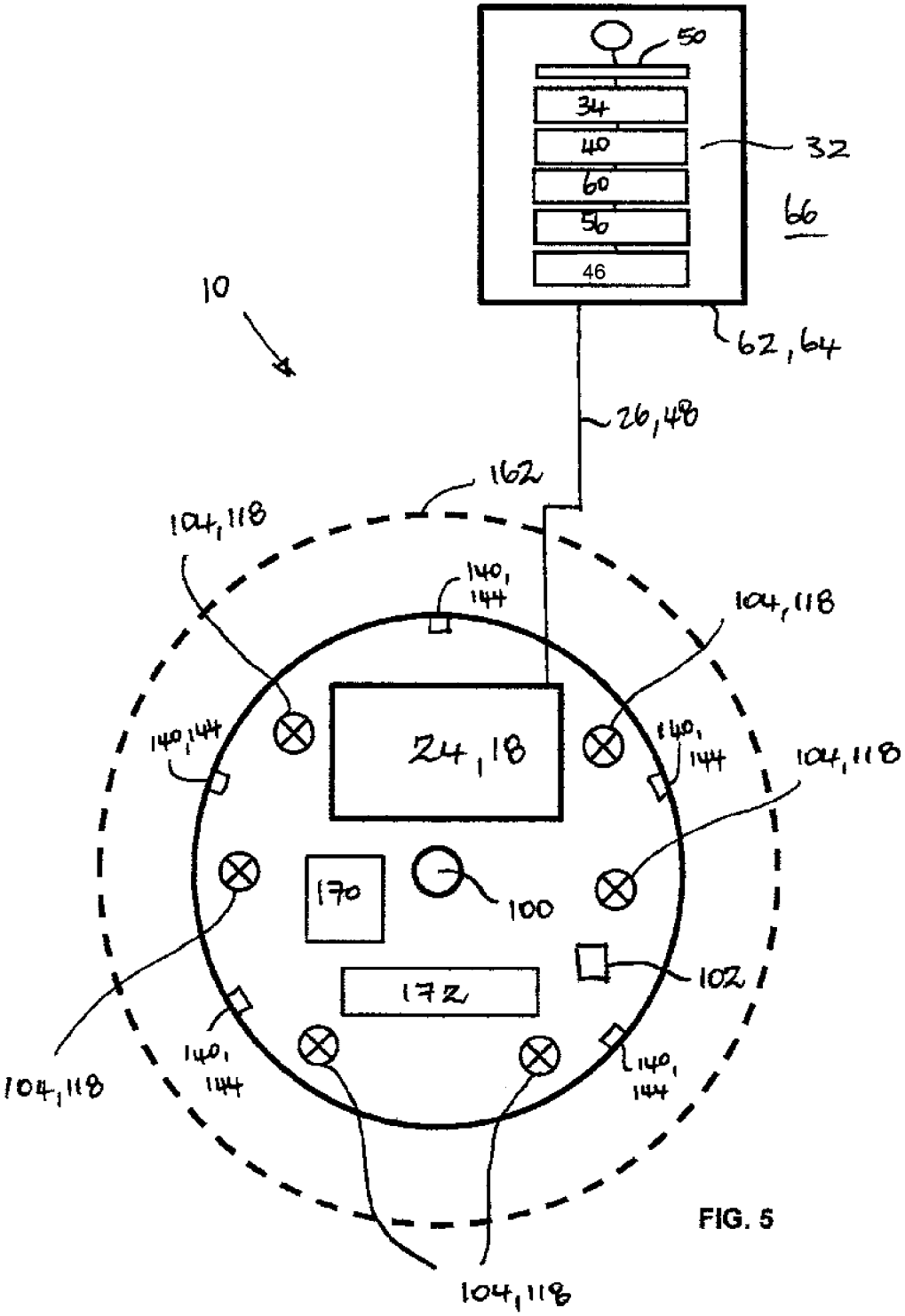
FIG. 5 is a schematic top view of one embodiment of the present invention showing an FLNG vessel with a circular footprint with a topsides hydrocarbon processing facility on or above the deck including a liquefaction facility, an off-board gas pre-treatment facility on a fixed structure; and a system of azimuthal thrusters arranged around the circumference of the hull of the FLNG vessel; and, FIG. 6 is a schematic view of one embodiment of the system showing the computer processor and storage means.

In the embodiment illustrated in FIG. 5, the system of thrusters comprises a plurality of azimuthal thrusters. Referring to FIG. 5, the hull (14) of the FLNG vessel (12) has a circular footprint with six azimuthal thrusters arranged around the circumference of the hull, by way of illustration only. It is to be understood that that the number of azimuthal thrusters can vary. Using this system of thrusters, the DP control system of the present invention achieves heading control of the FLNG vessel by adjusting one or both of the output and the angle of at least one of the plurality of azimuthal thrusters during offloading operations.

Figure 6:
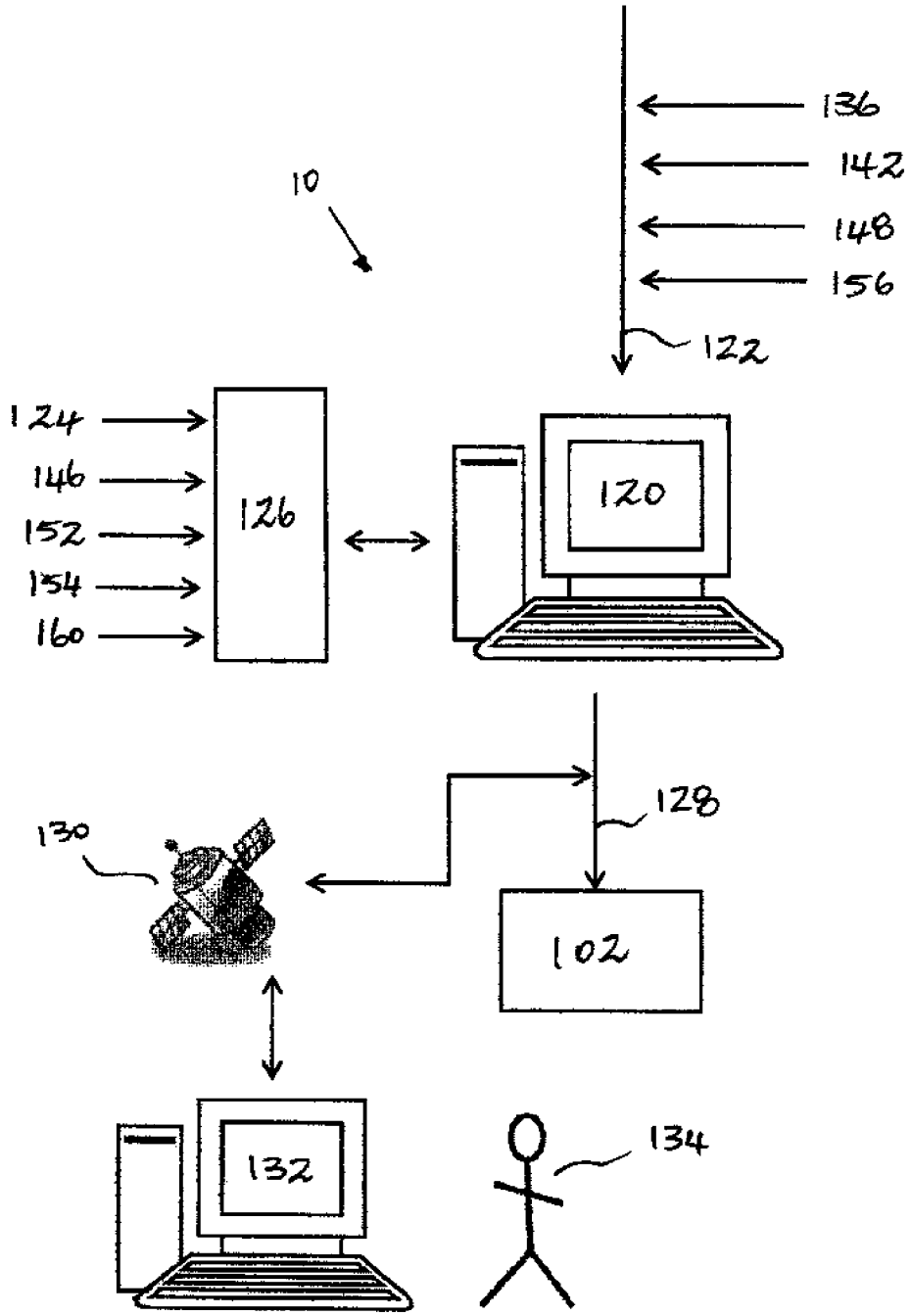

Referring to FIG. 6, the system (10) comprises a computer processor (120) for receiving a set of real-time monitored environmental data (122), wherein the computer processer is programmed with a mathematical algorithm to:

(i) compare the set of real-time monitored environmental data to a set of stored set points (124) held in a data storage means (126);

(ii) generate a heading control correction signal (128) when the set of real-time monitored environmental data exceeds or falls below one or more of the set of stored set points for the FLNG vessel; and, (iii) transmit the heading control correction signal to the dynamic positioning control system (102) during LNG production operations to optimize the heading of the FLNG vessel in response to the real-time monitored environmental data.

The computer processor can be monitored directly onboard the FLNG vessel. Alternatively or additionally, the computer processor can have source or executable instructions to communicate with a network (130) to form an executive dashboard (132) enabling a remote user (134) to view the set of real-time monitored environmental data 24 hours a day, 7 days as week. The real-time monitored environmental data can be stored to provide a measure of the cumulative load hours experienced by the FLNG vessel during offloading operations over the operating life of the FLNG vessel. The cumulative load hours can be used a guideline to inform a maintenance schedule for the FLNG vessel. Alternatively or additionally, the real-time monitored environmental data can be analyzed to update the mathematical algorithm or to reset the value of the set of stored set points (124).

In one embodiment of the present invention, the set of real-time monitored environmental data is a set of metocean data (136) sourced from an external data supplier such as a weather bureau or a third party contracted to compile the set of metocean data. The set of real-time monitored environmental data need not be sourced from the environment immediately adjacent to the station keeping point. Alternatively or additionally, the set of real-time monitored environmental data can be sourced from a remote sensing location (138) that is remote from the station keeping point (100) for the purposes of providing forward warning of a predicted change in environmental conditions. In this way, the set of real-time monitored environmental data acquired from a remote sensing location can be fed forward so that production operations occurring onboard the FLNG vessel can be scaled back or suspended in a timely manner in the event that the FLNG vessel needs to be relocated to avoid a severe weather event. For example, a change in the heading control signal can be initiated in anticipation of the FLNG vessel experiencing excessive pitch, yaw, roll, surge, sway, or heave, such as during a gale or a severe cyclone.

Advantageously, a heading control correction signal (128) can be initiated in response to the real-time monitored environmental data sourced from the one or more remote sensing locations (138) in anticipation of the FLNG vessel experiencing excessive pitch, yaw, roll, surge, sway, or heave, such as during a gale or a severe cyclone. In this way, the real-time monitored environmental data is used in a forward response predictive manner to transmit a change in the heading control correction signal to the dynamic positioning control system (102) during LNG production operations before a change in environmental conditions actually arrives at the station keeping point (100).

Alternatively or additionally, the system (10) includes a set of environmental sensors (140) for generating part or all of the set of real-time monitored environmental data rather than rely on external sources of environmental data. This is particularly advantageous when the FLNG vessel is operating in a remote location. The set of environmental sensors can include one or more of the following environmental condition data sensors: a wind sensor, a wave sensor, a current sensor, a swell sensor, a temperature sensor, a remote wave buoy, or combinations thereof.

In order to monitor the integrity of the hull of the FLNG vessel over its operating life, the set of real-time monitored environmental data can include a set of real-time hull integrity data (142), for example, a set of real-time hull strain data associated with a level of strain experienced by the hull of the FLNG vessel. The set of hull integrity data can be generated in part or in full by one or more of the following hull integrity sensors (144): a FLNG hull strain gauge, a FLNG vessel draft sensor, a FLNG vessel trim sensor, a FLNG vessel pitch sensor, a FLNG vessel yaw sensor, a FLNG vessel roll sensor, a FLNG vessel surge sensor, and, a FLNG vessel heave sensor. The set of stored set points held in the data storage means can therefore be a set of hull integrity set points (146). Using this embodiment, the computer processor receives a set of hull integrity data and the computer processer is programmed with a mathematical algorithm to:

(i) compare the set of real-time hull integrity data to a set of stored set of hull integrity set points held in a data storage means;

(ii) generate a heading control correction signal when the set of real-time hull integrity data exceeds or falls below one or more of the set of stored set of hull integrity set points for the FLNG vessel; and, (iii) transmit the heading control correction signal to the dynamic positioning control system to reduce the real-time strain being experienced by the hull of the FLNG vessel during offloading operations.

Each of the FLNG vessel cryogenic storage tanks is susceptible to fatigue loading. In addition, each of the FLNG vessel cryogenic storage tanks is susceptible to damage from cargo sloshing when the environmental conditions cause adverse hull motions, particularly when the tank is a partially filled tank. The present invention was developed in part to mitigate cryogenic tank sloshing damage by utilising tank and/or vessel motion measurement technology to control the heading of the FLNG vessel at an optimal angle relative to the wind, waves, and current to balance loads on the hull or to reduce sloshing in the FLNG vessel cargo containment system. In order to monitor the integrity of the cargo containment system of the FLNG vessel over its operating life, the set of real-time monitored environmental data can include a set of real-time cargo containment system strain data (148) associated with a level of strain experienced by the cargo containment system of the FLNG vessel during offloading operations. The set of real-time cargo containment system strain data can be generated in part or in full by one or more of the following cargo containment system strain sensors (150): a storage tank strain gauge, a storage tank pressure sensor, a storage tank level indicator, a storage tank temperature sensor; a storage tank loading rate sensor; a storage tank offloading rate sensor; a storage tank sloshing sensor; a storage tank cargo load sensor, or, a storage tank accelerometer. The set of stored set points held in the data storage means includes a set of cargo containment integrity set points (152). Using this embodiment, the computer processor receives a set of real-time cargo containment system strain data and the computer processer is programmed with a mathematical algorithm to:

(i) compare the set of real-time cargo containment system strain data to a set of stored set of cargo containment system integrity set points held in a data storage means;

(ii) generate a heading control correction signal when the set of real-time cargo containment system strain data exceeds or falls below one or more of the set of stored set of cargo containment system integrity set points for the FLNG vessel; and, (iii) transmit the heading control correction signal to the dynamic positioning control system to reduce the real-time strain being experienced by the cargo containment system of the FLNG vessel during LNG offloading operations.

Alternatively or additionally, the set of stored set points held in the data storage means can include a set of cargo containment sloshing set points (154). Using this embodiment, the computer processor receives a set of real-time cargo containment system strain data and the computer processer is programmed with a mathematical algorithm to:

(i) compare the set of real-time cargo containment system strain data to a set of stored set of cargo containment system sloshing set points held in a data storage means;

(ii) generate a heading control correction signal when the set of real-time cargo containment system strain data exceeds or falls below one or more of the set of stored set of cargo containment system sloshing set points for the FLNG vessel; and, (iii) transmit the heading control correction signal to the dynamic positioning control system to reduce the sloshing being experienced by the cargo containment system of the FLNG vessel during LNG offloading operations.

The topsides hydrocarbon processing facility includes a plurality of topsides processing equipment that can similarly be affected by FLNG vessel motions. This can lead to liquid level control problems or 'maldistribution', which is analogous to the sloshing experience in partially filled cargo containment tanks but may involve gas/liquid interfaces such as within the main cryogenic heat exchanger. FLNG vessel motions in response to environmental impact can also lead to flow control problems within the topsides processing equipment which can have an adverse affect on process control or process reliability. The plurality of topsides processing equipment is also subject to mechanical fatigue or corrosion fatigue as a consequence of vessel motions as a function of cumulative impact of the real-time environmental conditions. The dynamic positioning control system of the FLNG vessel can be used to mitigate the effect of the FLNG vessel motion on the reliability and integrity of the plurality of topsides processing equipment by utilising vessel motion measurement technology to help orientate the FLNG vessel in an optimum heading. Wind and sea forces can be acting in different directions, with wind forces normally forcing prior art FLNG vessels to weathervane around a single point mooring system. Using a dynamic positioning control system to set the heading of the FLNG vessel in the manner described in detail below for the various embodiments of the present invention, allows for the heading of the FLNG vessel to be optimised over a large range of atmospheric conditions and sea states, thereby allowing the topsides process equipment to be operated more efficiently, increasing the reliability and integrity of the topsides process equipment within the topsides hydrocarbon production facility.

In order to reduce the loads being experienced by the topsides hydrocarbon production facility of the FLNG vessel over its operating life, the set of real-time monitored environmental data can include a set of real-time LNG production data (156) associated with the topsides hydrocarbon production facility onboard the FLNG vessel. The set of LNG production data can be generated in part or in full by one or more of the following LNG production sensors (158): a flow rate sensor for the outlet stream of the liquefaction facility; a LNG temperature sensor; a loading rate sensor for each of the plurality of FLNG vessel cryogenic storage tanks; a pressure sensor for each of the plurality of FLNG vessel cryogenic storage tanks; an offloading rate sensor for each of the plurality of FLNG vessel cryogenic storage tanks. The set of stored set points held in the data storage means is a set of topsides hydrocarbon production facility integrity set points (160). Using this embodiment, the computer processor receives a set of real-time LNG production data and the computer processer is programmed with a mathematical algorithm to:

(i) compare the set of LNG production data to a set of stored set of topsides hydrocarbon production facility integrity set points held in a data storage means;

(ii) generate a heading control correction signal when the set of LNG production data exceeds or falls below one or more of the set of stored set of topsides hydrocarbon production facility integrity set points for the FLNG vessel; and, (iii) transmit the heading control correction signal to the dynamic positioning control system to reduce the cumulative load experienced by the topsides hydrocarbon production facility of the FLNG vessel during LNG offloading operations.

Alternatively or additionally, the set of stored set points held in the data storage means is a set of topsides hydrocarbon production facility liquid level or flow control set points (160). Using this embodiment, the computer processor receives a set of real-time LNG production data and the computer processer is programmed with a mathematical algorithm to:

(i) compare the set of LNG production data to a set of stored set of topsides hydrocarbon production facility liquid level or flow control set points held in a data storage means;

(ii) generate a heading control correction signal when the set of LNG production data exceeds or falls below one or more of the set of stored set of topsides hydrocarbon production facility liquid level or flow control set points for the FLNG vessel; and, (iii) transmit the heading control correction signal to the dynamic positioning control system to optimize one or both of the efficiency or reliability by the topsides hydrocarbon production facility of the FLNG vessel during LNG offloading operations.

During offloading operations, an LNG tanker (70) may be moored to the FLNG vessel (12) using a traditional side-by-side multiple rope mooring arrangement or a traditional tandem offloading arrangement. In one embodiment, the DP control system (102) maintains the FLNG vessel at a desired heading whilst maintaining a safe separation distance between the FLNG vessel and LNG tanker during LNG offloading operations. The LNG tanker may be fitted with its own dynamic positioning control system. In any event, the system of thrusters (104) of the FLNG vessel can be used to maintain a safe separation distance of the FLNG vessel and the LNG tanker during offloading. For example, the safe separation distance can be as low as 3 meters for side-by-side offloading or in the range of range from about 50 meters to 150 meters for tandem offloading. In this way, the system of the present invention is used to provide heading control alone or a combination of heading control and station keeping control during LNG offloading operations.

Advantageously, the dynamic positioning control system can maintain the FLNG vessel at a desired heading around a station keeping point during LNG offloading operations in such a manner that the FLNG vessel provides a breakwater for the smaller LNG tanker during LNG offloading operations. The dynamic positioning control system can also maintain the FLNG vessel at a desired heading around a station keeping point so that the FLNG vessel provides a breakwater whilst the LNG tanker is approaching the FLNG vessel in preparation for side by side offloading. In the embodiment illustrated in FIG. 1, the LNG tanker (70) is moored on the lee side (210) of the FLNG vessel in a side-by-side mooring arrangement.

When the LNG tanker (70) is available for offloading, a fluid connecting device (200) of the kind known in the art, for example one or more flexible conduits, is used for fluidly connecting the FLNG vessel to the LNG tanker to allow offloading of LNG from the FLNG vessel to the LNG tanker. By way of example, the fluid connection device can comprise one or more LNG flexible hoses hung freely between the FLNG vessel and the LNG tanker when the FLNG vessel operates in DP mode using the DP control system. Alternatively, the fluid connecting device can be, or can include, one or more rigid articulated loading arms known in the art for use in LNG offloading. When the offloading operation has been completed, the fluid connecting device (200) is emptied according to the standard, known procedures in the art and disconnected from the FLNG vessel. Then the LNG tanker (70) can simply be disconnected.

The offload flexible conduit and the vapor return conduit can each be made from about eight inch to about 16 inch diameter rigid pipe, flexible composite cryogenic hose, or combinations thereof. The offload flexible conduit and the vapor return conduit can be any size or material as required for the particular application, given particular flow rates, pressures, and storm conditions. For example, the offload flexible conduit and the vapor return conduit can be three inch or larger diameter reinforced hose, a draped hose, or a festooned hose. It should be noted that LNG hoses of large dimensions (typically more than 12 inches) as of today are not qualified for dynamic applications. However, hoses of smaller diameters, typically up to 12 inches, are qualified. By using several parallel LNG hoses, it is thus possible to make use of qualified technology in connection with embodiments of the present invention.

In one embodiment an outlet stream of LNG (28) from the liquefaction facility (24) of the FLNG vessel (12) is directed to flow through the fluid connection device (200) directly into the LNG tanker cargo containment system (72) of the LNG tanker (70) without first having been stored in the FLNG vessel cargo containment system (20). Alternatively, or additionally, a cargo stream of LNG (202) may be offloaded from the FLNG vessel cargo containment system to the LNG tanker cargo containment system via the fluid connection device. In either case, once a cargo of LNG has been offloaded to the LNG tanker, the LNG tanker is used to transport the cargo of LNG from an offloading location (204) to a delivery location (not shown). The delivery location can be onshore or offshore. The FLNG vessel remains in the station-keeping envelope at the offloading location awaiting the arrival of another LNG tanker whilst the LNG tanker departs to a delivery location to off-load some or all of its cargo LNG.

A stream of hydrocarbon vapour (206) is formed during cargo offloading operations and, in at least one embodiment, the stream of hydrocarbon vapour is returned to the FLNG vessel via a hydrocarbon vapour return line (208). For example, the stream of hydrocarbon vapour can flow back to the FLNG vessel through a hydrocarbon vapour return line that forms a part of the first connecting device (200). The first connecting device and the hydrocarbon vapour return line can be selected from the group comprising: a rigid articulated loading arm, a flexible composite cryogenic hose, a reinforced hose, a draped hose, or a festooned hose.

If desired, the FLNG vessel may be operated in dynamic positioning mode for station keeping in addition to heading control. The system of thrusters (104) is sufficient to achieve station keeping for the FLNG vessel (12) at the station keeping point (100) and in this way, the system of thrusters operate in combination with the DP control system to serve the function of a propulsion system for moving the FLNG vessel from a first location to a second location within a station keeping envelope (162) during LNG offloading operations. The system may optionally include a dedicated FLNG vessel propulsion system (164) in the form of a main propulsion engine (166) and a propeller (168). The main propulsion engine can be any ship propulsion system known in the art, such as a dual fuel gas turbine system, a dual fuel diesel motor system, a dual fuel diesel-electric system, a steam turbine system, a direct drive diesel motor system, and, a diesel-engine-powered electric motor system. The propeller can be a variable pitch propeller or screw fixed propellers. In the embodiment illustrated in FIG. 3 and FIG. 4, the FLNG vessel includes the dedicated propulsion system for moving the FLNG vessel from a first location to a second location within the station keeping envelope. In the embodiment illustrated in FIG. 1 and FIG. 2, the FLNG vessel does not include a dedicated propulsion system, relying instead on a system of thrusters to operated under control of the DP control system to move the FLNG vessel from the first location to the second location within the station keeping envelope.

The system (10) includes a power generation and distribution system (170) for sharing power between the dynamic positioning control system (102) and the topsides hydrocarbon processing facility (18). The power generation and distribution system can also provide power to a plurality of additional systems (76). When the FLNG vessel is provided with a dedicated propulsion system (164), the power generation and distribution system is configured share power between the dynamic positioning control system, the topsides hydrocarbon processing facility, and the dedicated propulsion system.

The power requirements for the dynamic positioning control system (102) are characterised by long periods of low power consumption (less than about 10 MW) and short periods of very high power consumption (in the range of about 20 MW to 50 MW) during relatively brief extreme sea and atmospheric condition. In the embodiment illustrated in FIG. 5, the power generation and distribution system (170) is configured to charge a battery bank (172) for the dynamic positioning control system (102) when one or both of the dedicated propulsion system (164) and the topsides hydrocarbon processing facility (18) is experiencing an off-peak load condition. As power needs increase for the dynamic positioning control system during LNG offloading operations, the power distribution system redistributes load by reducing loads from less critical equipment such as that used in the topsides hydrocarbon processing facility.

In one or more embodiments, the stream of hydrocarbon vapour (206) can be used as fuel for the propulsion system, the power generation system or the battery bank of the DP control system.

Conventional arrangements for mooring of an FLNG vessel in a benign environment rely on 'spread mooring' which fixes the position and heading of the FLNG vessel at all times during an offloading phase. In all other less benign environments, conventional arrangements proposed for mooring of an FLNG vessel rely on station keeping via a large mechanical single point mooring system with the orientation of the FLNG vessel being primarily governed by the magnitude and direction of the winds or the magnitude and direction of the waves that cause the FLNG vessel to weathervane around a large expensive mechanical single point mooring system. Heading control under these circumstances requires the LNG vessel to be held at a station keeping point using a large expensive mechanical single point mooring system with a non-weathervaning heading being achieved using either (i) the use of stern thrusters or (ii) the intervention of a separate self-propelled vessel such as a tug boat applying a local pushing or pulling force to the hull of the FLNG vessel. In contrast, the system of the presently claimed invention generates a heading control signal to the a dynamic positioning control system to generate the necessary balancing forces required to optimise the heading of the FLNG vessel relative to a set of environmental conditions during offloading operations. The heading control signal may bring the FLNG vessel into a heading that differs from what is achieved using the single point mooring system and tug-boat combination, or, the single point mooring system and stern thruster combination of the prior art. In the event that the FLNG vessel is experiencing an orthogonal, bi-directional, or multi-directional sea state, the system of the presently invention is particularly advantageous compared with allowing the FLNG vessel to weathervane freely around a prior art single point mooring system.

Now that several embodiments of the invention have been described in detail, it will be apparent to persons skilled in the relevant art that numerous variations and modifications have been enabled by the foregoing disclosure. By way of example, the FLNG vessel may be operated in dynamic positioning mode for station keeping in addition to heading control. By way of further example, the DP control system may be located on the FLNG vessel itself or operated from a remote DP operation location. All such modifications and variations are considered to be within the scope of the present invention, the nature of which is to be determined from the foregoing description and the appended claims.

It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A system for offshore production of liquefied natural gas (LNG) from a floating liquefied natural gas (FLNG) vessel, wherein the system is connected to a natural gas receiving system, wherein the system comprises:

a FLNG vessel comprising a hull and a deck;

a topsides hydrocarbon processing facility installed at or above the deck of the hull of the FLNG vessel;

a FLNG vessel cargo containment system comprising one or more insulated FLNG vessel cryogenic storage tanks installed within the hull of the FLNG vessel, the FLNG vessel being un-moored to a sea bed so as to facilitate dynamic positioning of the FLNG vessel during system operation;

a dynamic positioning control system operatively associated with a system of thrusters onboard the FLNG vessel wherein the dynamic positioning control system maintains the FLNG vessel at a desired heading around a station keeping point during LNG cargo offloading operations; and a computer processor for receiving a set of real-time monitored environmental data, wherein the computer processor is programmed with a mathematical algorithm to:

(i) compare the set of real-time monitored environmental data to a set of stored set points held in a data storage means;

(ii) generate a heading control correction signal when the set of real-time monitored environmental data exceeds or falls below one or more of the set of stored set points for the FLNG vessel; and (iii) transmit the heading control correction signal to the dynamic positioning control system;

wherein the set of real-time monitored environmental data includes a set of real-time monitored cargo containment system strain data associated with a level of strain experienced by the FLNG vessel cargo containment system, and, the set of stored set points held in the data storage means includes a set of real-time monitored cargo containment system integrity set points.

2. The system for offshore production of LNG of claim 1, wherein the set of real-time monitored cargo containment system strain data is generated in part or in full by one or more of the following hull integrity sensors: a storage tank strain gauge, a storage tank pressure sensor, a storage tank level indicator, a storage tank temperature sensor; a storage tank loading rate sensor; a storage tank offloading rate sensor; a storage tank sloshing sensor; a storage tank cargo load sensor, and, a storage tank accelerometer.

3. The system for offshore production of LNG of claim 1, wherein the set of stored set points held in the data storage means includes a set of stored cargo containment system sloshing set points.

4. The system for offshore production of LNG of claim 1, wherein the computer processor has source or executable instructions to communicate with a network to form an executive dashboard enabling a remote user to view the set of real-time monitored environmental data 24 hours a day, 7 days a week.

5. The system for offshore production of LNG of claim 1, wherein the set of real-time monitored environmental data includes a set of metocean data sourced from an external data supplier.

6. The system for offshore production of LNG of claim 5, wherein the set of metocean data is sourced from a sensing location that is remote from the station keeping point for providing forward warning of a predicted change in environmental conditions during offloading operations.

7. The system for offshore production of LNG of claim 1, wherein the system includes a set of environmental sensors for generating part or all of the set of real-time monitored environmental data.

8. The system for offshore production of LNG of claim 7, wherein the set of environmental sensors includes one or more of the following environmental condition data sensors: a wind sensor, a wave sensor, a current sensor, a swell sensor, a temperature sensor, a remote wave buoy, or combinations thereof.

9. The system for offshore production of LNG of claim 1, wherein the set of real-time monitored environmental data includes a set of LNG production data associated with the production of LNG by the topside hydrocarbon production facility.

10. The system for offshore production of LNG of claim 9, wherein the topside hydrocarbon production facility includes a liquefaction facility having an output stream of LNG and the set of LNG production data comprises data generated by one or more of the following: a flow rate sensor for the outlet stream of LNG from the liquefaction facility; a LNG temperature sensor; a loading rate sensor for each of the one or more insulated FLNG vessel cryogenic storage tanks; a pressure sensor for each of the plurality of FLNG vessel cryogenic storage tanks; an offloading rate sensor for each of the plurality of FLNG vessel cryogenic storage tanks.

11. The system for offshore production of LNG of claim 9, wherein the set of stored set points held in the data storage means includes a set of stored topsides hydrocarbon processing facility integrity set points.

12. The system for offshore production of LNG of claim 9, wherein the set of stored set points held in the data storage means includes a set of stored topsides hydrocarbon processing facility liquid level or flow control set points.

13. The system for offshore production of LNG of claim 1, wherein the system of thrusters includes one or more tunnel or pod thrusters, each tunnel or pod thruster having an adjustable thruster output, and, the dynamic positioning control system maintains the FLNG vessel at the desired heading around the station keeping point during LNG production operations by adjusting the output of the one or more tunnel or pod thrusters.

14. The system for offshore production of LNG of claim 1, wherein the system of thrusters includes one or more azimuthal thrusters, each azimuthal thruster having an adjustable thruster output and an adjustable thruster angle and, the dynamic positioning control system maintains the FLNG vessel at the desired heading around the station keeping point during LNG production operations by adjusting one or both of the output and the angle of at least one of the one or more azimuthal thrusters.

15. The system for offshore production of LNG of claim 1, wherein the system of thrusters comprises one or more tunnel or pod thrusters, each tunnel or pod thruster having an adjustable thruster output, and, one or more azimuthal thrusters, each azimuthal thruster having an adjustable thruster output and an adjustable thruster angle, and, the dynamic positioning control system achieves heading control of the FLNG vessel by adjusting one or both of (i) the output and the angle of at least one of the plurality of azimuthal thrusters; and (ii) the output of the tunnel or pod thruster.

16. The system for offshore production of LNG of claim 1, wherein the system includes a power generation and distribution system for sharing power between the dynamic positioning control system and the topsides hydrocarbon processing facility.

17. The system for offshore production of LNG of claim 16, wherein the power generation and distribution system is configured to charge a battery bank for the dynamic positioning control system when the topsides hydrocarbon processing facility is experiencing an off-peak load condition.

18. The system for offshore production of LNG of claim 1, wherein the FLNG vessel is operated in dynamic positioning mode for station keeping in addition to heading control.

19. The system for offshore production of LNG of claim 1, wherein the dynamic positioning control system is located on the FLNG vessel.

20. The system for offshore production of LNG of claim 1, wherein the real-time monitored environmental data is stored to provide a measure of a cumulative load hours experienced by the FLNG vessel over an operating life of the FLNG vessel for providing a guideline to inform a maintenance schedule for the FLNG vessel.

21. The system for offshore production of LNG of claim 1, wherein the real-time monitored environmental data is analyzed to update the mathematical algorithm or to reset the set of stored set points.

22. A method for offshore production of LNG from an FLNG vessel, the FLNG vessel comprising a hull and a deck, a topsides hydrocarbon processing facility installed at or above the deck of the hull of the FLNG vessel, and a FLNG vessel cargo containment system comprising one or more insulated FLNG vessel cryogenic storage tanks installed within the hull of the FLNG vessel, the method comprising:

maintaining, via a dynamic positioning control system that operates a system of thrusters onboard the FLNG vessel, the FLNG vessel at a desired heading around a station keeping point during LNG cargo offloading operations and while the FLNG vessel is un-moored to a sea bed;

receiving a set of real-time monitored environmental data; and via the computer processor:

comparing the set of real-time monitored environmental data to a set of stored set points held in a data storage means;

generating a heading control correction signal when the set of real-time monitored environmental data exceeds or falls below one or more of the set of stored set points for the FLNG vessel; and transmitting the heading control correction signal to the dynamic positioning control system;

wherein the set of real-time monitored environmental data includes a set of real-time monitored cargo containment system strain data associated with a level of strain experienced by the FLNG vessel cargo containment system, and, the set of stored set points held in the data storage means includes a set of real-time monitored cargo containment system integrity set points.

* * * * *